US012576956B2

(12) United States Patent
Koga et al.

(10) Patent No.: US 12,576,956 B2
(45) Date of Patent: Mar. 17, 2026

(54) PROPULSION DEVICE FOR MARINE VESSEL AND OUTBOARD MOTOR

(71) Applicant: YAMAHA HATSUDOKI KABUSHIKI KAISHA, Iwata (JP)

(72) Inventors: Hiroki Koga, Shizuoka (JP); Jun Ebuchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 408 days.

(21) Appl. No.: 18/213,936

(22) Filed: Jun. 26, 2023

(65) Prior Publication Data

US 2023/0415871 A1 Dec. 28, 2023

(30) Foreign Application Priority Data

Jun. 27, 2022 (JP) ..... 2022-102553

(51) Int. Cl.
*B63H 3/00* (2006.01)
*B63H 20/14* (2006.01)

(52) U.S. Cl.
CPC ..... *B63H 3/008* (2013.01); *B63H 20/14* (2013.01)

(58) Field of Classification Search
CPC ..... B63H 3/008; B63H 20/14
See application file for complete search history.

(56) References Cited

U.S. PATENT DOCUMENTS

| | | | | |
|---|---|---|---|---|
| 4,900,280 | A | 2/1990 | Midttun | |
| 4,950,187 | A | 8/1990 | Smith | |
| 2021/0284311 | A1 | 9/2021 | Ikegaya | |
| 2021/0316834 | A1 * | 10/2021 | Kimpara | B63H 23/06 |

FOREIGN PATENT DOCUMENTS

| | | | |
|---|---|---|---|
| EP | 2 520 487 | A2 | 11/2012 |
| JP | 2021-146755 | A | 9/2021 |
| WO | 2005/012078 | A1 | 2/2005 |

OTHER PUBLICATIONS

Official Communication issued in corresponding European Patent Application No. 23179523.8, mailed on Dec. 5, 2023.

* cited by examiner

*Primary Examiner* — Stephen P Avila
(74) *Attorney, Agent, or Firm* — Keating & Bennett, LLP

(57) ABSTRACT

A propulsion device for a marine vessel includes a driving source including at least one electric motor, a propeller including blades with changeable pitches and rotatable around a central axis of a propeller shaft together with the propeller shaft, a propeller shaft rotation driver to transmit a driving force from the driving source to the propeller shaft and rotate the propeller shaft around the central axis, and a pitch change driver to transmit the driving force from the driving source to the blades and change pitches of the blades. The propeller shaft rotation driver includes a first shaft, and the pitch change driver includes a second shaft closer to a bow side of the marine vessel than the first shaft.

16 Claims, 7 Drawing Sheets

PROPULSION DEVICE FOR MARINE VESSEL AND OUTBOARD MOTOR

CROSS REFERENCE TO RELATED APPLICATIONS

This application claims the benefit of priority to Japanese Patent Application No. 2022-102553 filed on Jun. 27, 2022. The entire contents of this application are hereby incorporated herein by reference.

BACKGROUND OF THE INVENTION

1. Field of the Invention

The present invention relates to a propulsion device for a marine vessel, and an outboard motor.

2. Description of the Related Art

Conventionally, a marine vessel propulsion device including an engine and an electric motor is known as a driving source for driving a propeller. Such a marine vessel propulsion device includes a switching mechanism to switch between the engine and the electric motor, and for example, in the case of being desired to output a propulsion force from the propeller at high output (that is, in the case of a high speed range), the engine is used, and on the other hand, in the case of being desired to output the propulsion force from the propeller at low output (that is, in the case of a low speed range), the electric motor is used (for example, see Japanese Laid-Open Patent Publication (kokai) No. 2021-146755).

As is well known, the realization of carbon-free mobile bodies is being promoted as a means of achieving the SDGs (Sustainable Development Goals) advocated in recent years, and the power source of an automobile, which is an example of the mobile body, is being replaced from a hybrid form of an engine and an electric motor, to an electric motor alone. Furthermore, in marine vessel propulsion devices, similar to automobiles, replacement with only electric motors as the power source is under consideration.

Due to the output characteristics of the electric motor, the higher the rotation speed, the worse the power efficiency (the electric efficiency). Therefore, in the automobile, a transmission or the like is used to suppress the rotation of the electric motor even during high-speed operation, thereby suppressing the deterioration of the power efficiency.

On the other hand, a marine vessel propulsion device, especially an outboard motor, usually does not include a transmission, and a pitch (a blade angle) of the blades of a propeller is not changeable. Since the pitch of the blades of the propeller is usually designed so that the propulsion efficiency of the propeller becomes optimal when the maximum output of the power source is generated, there is a tendency that the propulsion efficiency of the propeller is lowered in a medium and low speed range where the power source does not generate the maximum output, and the power efficiency of the electric motor is deteriorated. Therefore, there is room for improvement in terms of the power efficiency.

SUMMARY OF THE INVENTION

Preferred embodiments of the present invention provide propulsion devices for marine vessels, and outboard motors that are each able to improve the power efficiency of an electric motor.

According to a preferred embodiment of the present invention, a propulsion device for a marine vessel that propels the marine vessel includes a driving source including at least one electric motor, a propeller including a plurality of blades with changeable pitches and rotatable around a central axis of a propeller shaft together with the propeller shaft, a propeller shaft rotation driver to transmit a driving force from the driving source to the propeller shaft and rotate the propeller shaft around the central axis, and a pitch change driver to transmit the driving force from the driving source to the plurality of blades and change the pitches of the plurality of blades. The propeller shaft rotation driver includes a first shaft, and the pitch change driver includes a second shaft closer to a bow side of the marine vessel than the first shaft.

According to another preferred embodiment of the present invention, an outboard motor that propels a marine vessel includes a driving source including at least one electric motor, a propeller including a plurality of blades with changeable pitches and rotatable around a central axis of a propeller shaft together with the propeller shaft, a propeller shaft rotation driver to transmit a driving force from the driving source to the propeller shaft and rotate the propeller shaft around the central axis, and a pitch change driver to transmit the driving force from the driving source to the plurality of blades and change pitches of the plurality of blades.

According to preferred embodiments of the present invention, since it is possible to change the pitches of the plurality of blades of the propeller, it is possible to prevent the propulsion efficiency of the propeller from being lowered even in the medium and low speed range where the power source does not generate the maximum output. As a result, it is possible to improve the power efficiency of the electric motor.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 6A is a cross-sectional view taken along a line B-B in FIG. 3, and FIG. 6B is a cross-sectional view taken along a line B'-B' in FIG. 4.

DETAILED DESCRIPTION OF THE PREFERRED EMBODIMENTS

Hereinafter, preferred embodiments of the present invention will be described with reference to the drawings.

However, configurations described in the following preferred embodiments are merely examples, and the scope of the present invention is not limited by the configurations described in the following preferred embodiments. For example, respective components of the present invention are able to be replaced with arbitrary components that can exhibit the same functions. Moreover, arbitrary components may be added. In addition, arbitrary two or more configurations (features) of the following preferred embodiments are able to be combined. Furthermore, in FIGS. 1, 3, 4, 5, 6A, and 6B, an X-axis, a Y-axis, and a Z-axis that are perpendicular to each other are set. The X-axis is an axis parallel to a longitudinal direction of a marine vessel. The Y-axis is an axis parallel to a width direction of the marine vessel. The Z-axis is an axis parallel to a height direction of the marine vessel. In addition, a direction in which an arrow of each of the X-axis, the Y-axis, and the Z-axis points is defined as "positive", and an opposite direction of "positive" is defined as "negative". In the marine vessel, the positive side of the X-axis is the bow side, the negative side of the X-axis is the stern side, the positive side of the Y-axis is the starboard side, the negative side of the Y-axis is the port side, the positive side of the Z-axis is the upper side, and the negative side of the Z-axis is the lower side.

Figure 1:
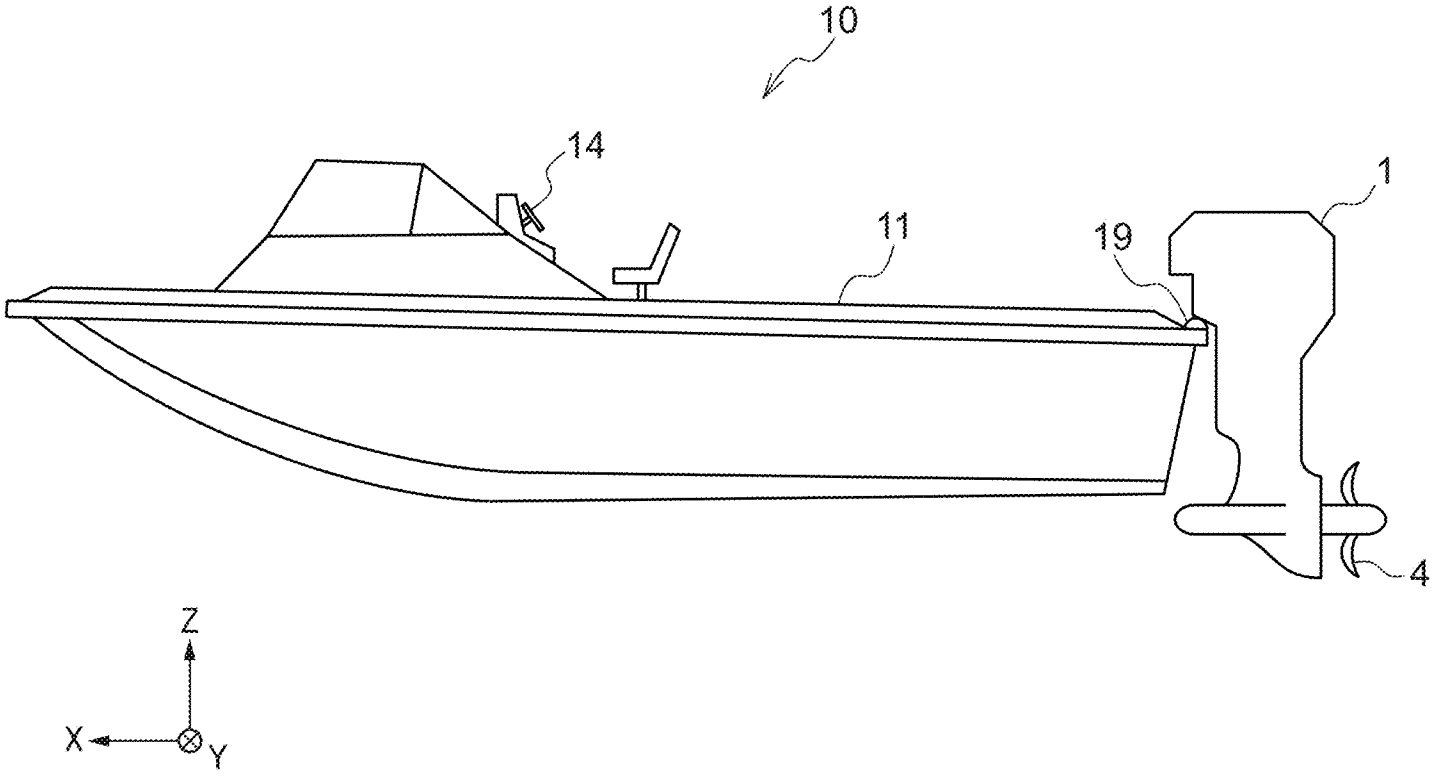
FIG. 1 is a side view of a marine vessel including a propulsion device (an outboard motor) according to a first preferred embodiment of the present invention.

Hereinafter, a first preferred embodiment of the present invention will be described with reference to FIGS. 1 to 6A and 6B. FIG. 1 is a side view of a marine vessel 10 provided with a propulsion device (an outboard motor) according to the first preferred embodiment of the present invention. The marine vessel 10 shown in FIG. 1 is a planing boat and includes a hull 11, and an outboard motor 1 that functions as a marine vessel propulsion device mounted on the hull 11. It should be noted that the number of outboard motors 1 to be mounted on the hull 11 may be one or may be a plurality. In the case that a plurality of outboard motors 1 are mounted on the hull 11, the respective outboard motors 1 are mounted side by side on the stern of the hull 11. In addition, a remote control unit 15 described below and a steering wheel 14 are provided near a maneuvering seat of the hull 11.

Figure 2:
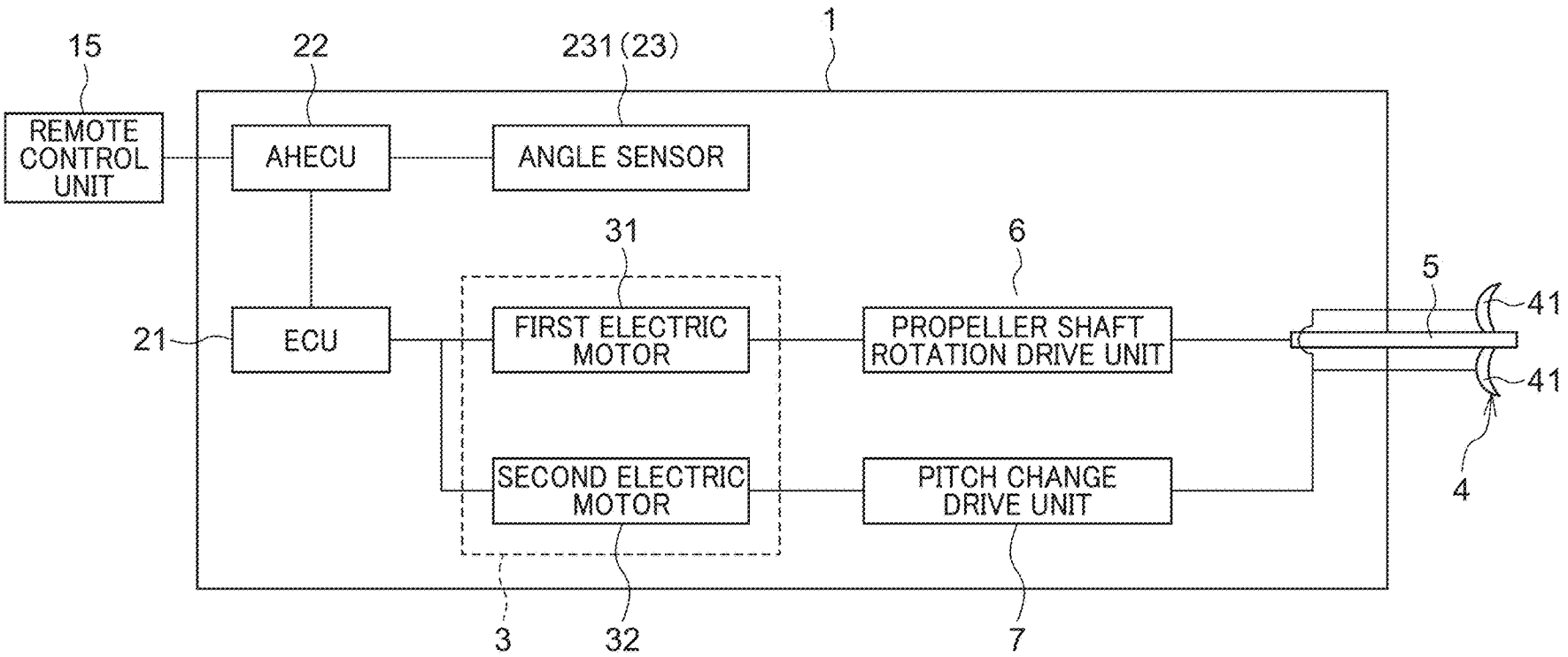
FIG. 2 is a block diagram that schematically shows a configuration of the propulsion device for the marine vessel shown in FIG. 1.

The outboard motor 1 rotates a propeller 4 to obtain a propulsion force to propel the marine vessel 10. The outboard motor 1 is attached to the stern of the hull 11 via an attachment unit 19, and rotates about a substantially vertical steering shaft (not shown) in the attachment unit 19 in response to an operation of the steering wheel 14. As a result, the marine vessel 10 is steered. FIG. 2 is a block diagram that schematically shows a configuration of the propulsion device shown in FIG. 1. As shown in FIG. 2, the outboard motor 1 includes a driving source 3 including a first electric motor 31 and a second electric motor 32, the propeller 4 including a plurality of blades 41 whose pitches are changeable, and a propeller shaft (a propulsion shaft) 5 to which the propeller 4 is connected. In addition, the outboard motor 1 includes a propeller shaft rotation drive unit 6 that rotates the propeller shaft 5, a pitch change drive unit 7 that changes the pitch (a pitch angle) of each of the plurality of blades 41, and an angle sensor 231 which functions as an information obtaining unit 23 that obtains information about the pitch angle of the plurality of blades 41. Among the two electric motors of the driving source 3, the first electric motor (one electric motor) 31 is connected to the propeller shaft rotation drive unit 6, and the second electric motor (the other electric motor) 32 is connected to the pitch change drive unit 7. In addition, the outboard motor 1 includes an ECU 21 that transmits drive signals to the first electric motor 31 and the second electric motor 32, respectively, and an AHECU (Actuator Head ECU) 22 which functions as a controller that requests the ECU 21 to switch a driving force in response to an input from the remote control unit 15.

Figure 3:
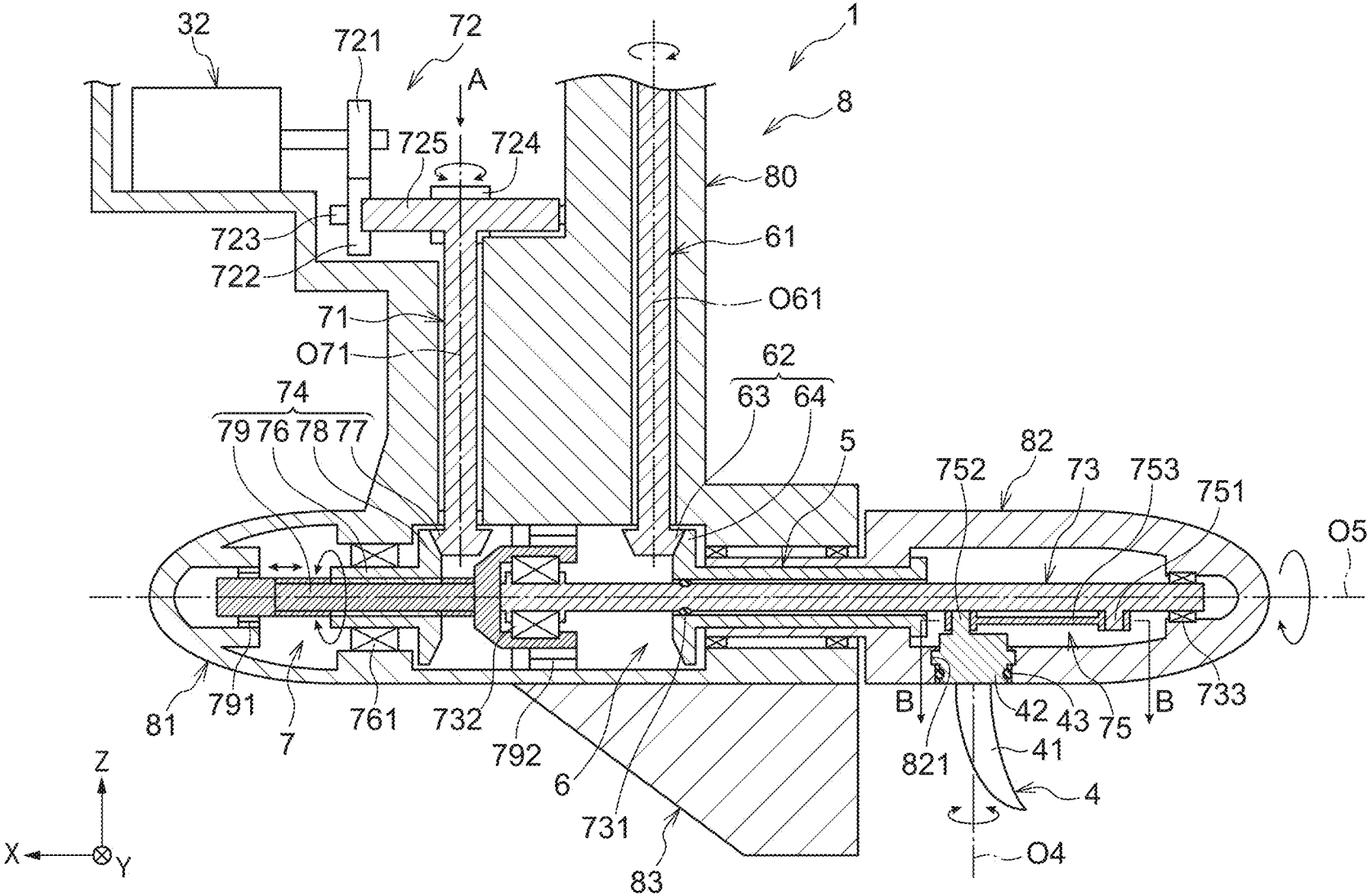
FIG. 3 is a schematic longitudinal section view of the propulsion device for the marine vessel shown in FIG. 1, and shows a state in which a pitch angle of a plurality of blades of a propeller is a minimum.
Figure 4:
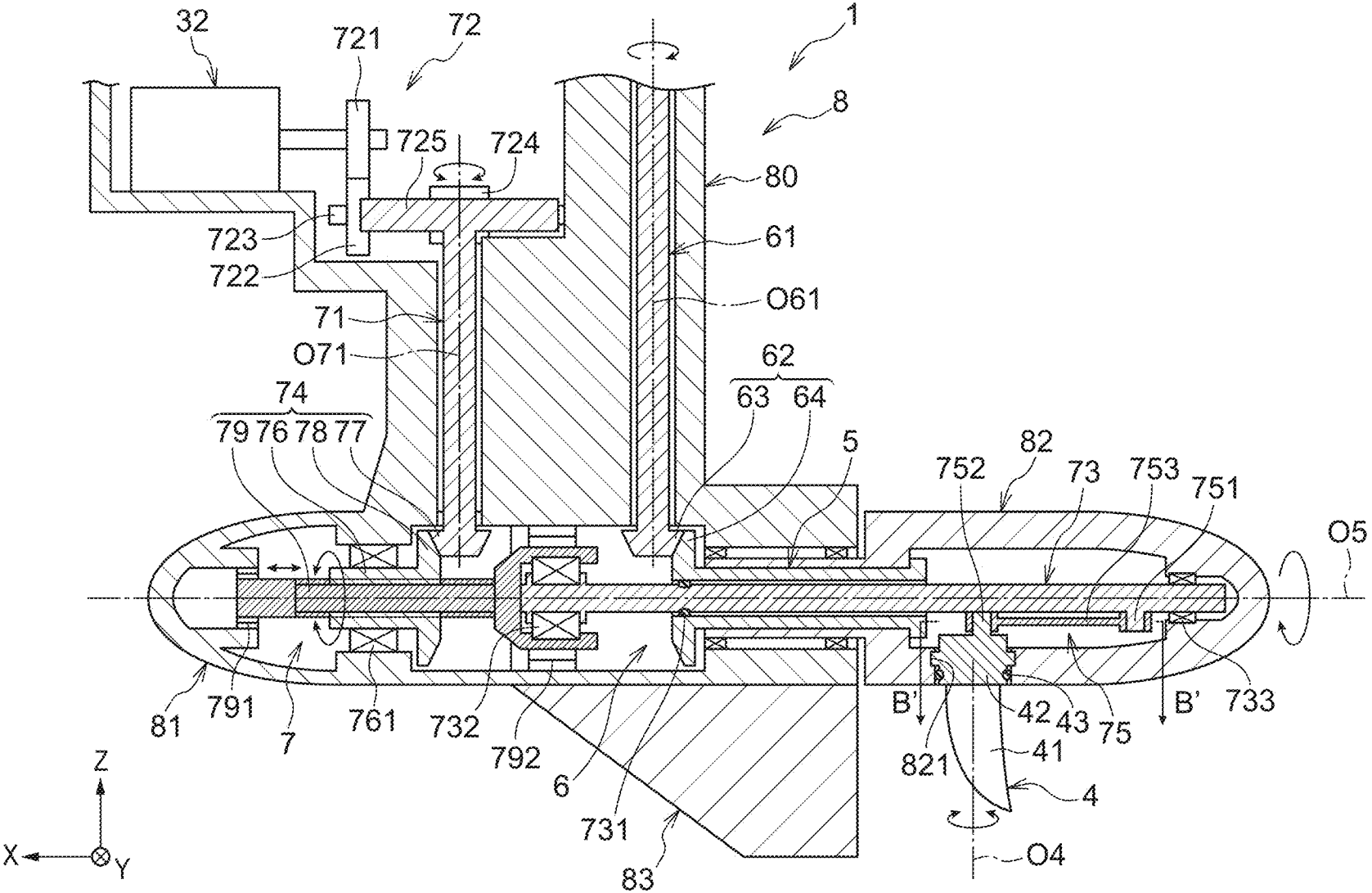
FIG. 4 is a schematic longitudinal section view of the propulsion device for the marine vessel shown in FIG. 1, and shows a state in which the pitch angle of the plurality of blades of the propeller is maximum.

FIG. 3 is a schematic longitudinal section view of the propulsion device shown in FIG. 1, and shows a state in which the pitch angle of each blade 41 of the propeller 4 is a minimum. FIG. 4 is a schematic longitudinal section view of the propulsion device shown in FIG. 1, and shows a state in which the pitch angle of each blade 41 of the propeller 4 is a maximum. As shown in FIGS. 3 and 4, the propeller shaft 5 has a cylindrical shape and a central axis O5 parallel or substantially parallel to the X-axis. The propeller 4 is connected to the rear end side of the propeller shaft 5 via a second protruding portion 82 of a case (a lower case) 8 which will be described below. As a result, the propeller 4 rotates around the central axis O5 of the propeller shaft 5 together with the propeller shaft 5. In addition, the second protruding portion 82 protrudes in a cylindrical shape toward the rear. The propeller 4 is a variable pitch propeller that includes the plurality of blades 41 whose pitches are changeable. The plurality of blades 41 are disposed at equal intervals along the circumferential direction of the second protruding portion 82. In addition, the propeller 4 includes a supporting portion 42 that supports the blades 41 so as to be rotatable around an axis O4 perpendicular to the central axis O5. The supporting portion 42 is a columnar (disc-like) portion provided at the base of the blades 41, and is fitted into a through hole 821 on the outer peripheral portion of the second protruding portion 82. The plurality of blades 41 rotate together with the supporting portion 42 around the axis O4, and thus, the pitch of each blade 41 is changed. In addition, an O-ring 43 is disposed between the second protruding portion 82 and the supporting portion 42 within the through hole 821.

The propeller shaft rotation drive unit 6 rotates the propeller shaft 5 together with the propeller 4 around the central axis O5. As shown in FIGS. 3 and 4, the propeller shaft rotation drive unit 6 includes a first shaft 61 having a columnar shape and a first converting portion 62. The first shaft 61 is disposed along a direction intersecting the central axis O5, that is, along the Z-axis direction. The first electric motor 31 is connected to the upper side of the first shaft 61. As a result, the driving force from the first electric motor 31 is transmitted to the first shaft 61, and the first shaft 61 rotates around a central axis O61 of the first shaft 61. It should be noted that in the configuration shown in FIGS. 3 and 4, the first shaft 61 has an outer diameter that is constant along the central axis O61, but is not limited to having the outer diameter that is constant along the central axis O61, and for example, the first shaft 61 may have a portion whose outer diameter varies along the central axis O61. It should be noted that the first shaft 61 is preferably connected to the first electric motor 31 via a speed reducer (not shown).

The first converting portion 62 converts a rotational force of the first shaft 61 into a rotational force that rotates the propeller shaft 5. The first converting portion 62 includes a first bevel gear 63 provided at the lower end portion of the first shaft 61 and a first bevel gear 64 provided at the front end portion of the propeller shaft 5. The first bevel gear 63 rotates together with the first shaft 61 around the central axis O61, and the first bevel gear 64 rotates together with the propeller shaft 5 around the central axis O5. In addition, the first bevel gear 63 and the first bevel gear 64 mesh with each other. Thus, the rotational force of the first shaft 61 is transmitted to the propeller shaft 5 via the first bevel gear 63 and the first bevel gear 64 as the rotational force that rotates the propeller shaft 5. Due to the propeller shaft rotation drive unit 6 being configured as described above, it is possible to transmit the driving force from the first electric motor 31 to the propeller shaft 5 and rapidly and smoothly rotate the propeller shaft 5 around the central axis O5 together with the propeller 4.

The pitch change drive unit 7 changes the pitch of each blade 41 of the propeller 4. As shown in FIGS. 3 and 4, the pitch change drive unit 7 includes a second shaft 71 having a columnar shape, a speed reduction portion (a speed reducer) 72, a pitch changing shaft 73 having a columnar shape, a second converting portion 74, and crank portions 75. The second shaft 71 is disposed along the Z-axis direction closer to the bow side of the marine vessel 10 than the first shaft 61, that is, the second shaft 71 is parallel or substantially parallel to the first shaft 61. It should be noted that in the configuration shown in FIGS. 3 and 4, the second shaft 71 has an outer diameter that is constant along a central axis O71, but is not limited to have the outer diameter that is constant along the central axis O71, and for example, the second shaft 71 may have a portion whose outer diameter varies along the central axis O71. A clearance (a center distance) between the central axis O61 of the first shaft 61 and the central axis O71 of the second shaft 71 is preferably about 2 to about 6 times a maximum outer diameter of the first shaft 61, and is more preferably about 3 to about 5 times the maximum outer diameter of the first shaft 61. As a result, for example, it is possible to increase the freedom in designing the layout of the internal structure of the outboard motor 1 while reducing or preventing an increase in the overall length of the outboard motor 1 along the X-axis direction.

Figure 5:
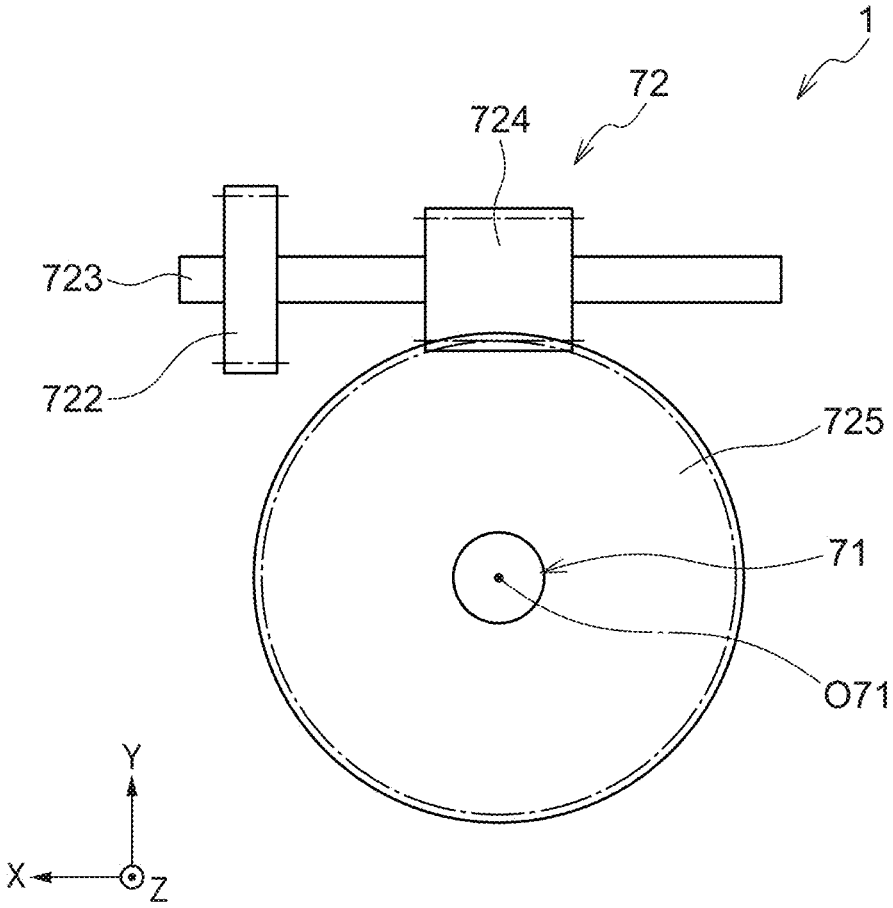
FIG. 5 is a view viewed from a direction of an arrow A in FIG. 3.
Figure 6A:
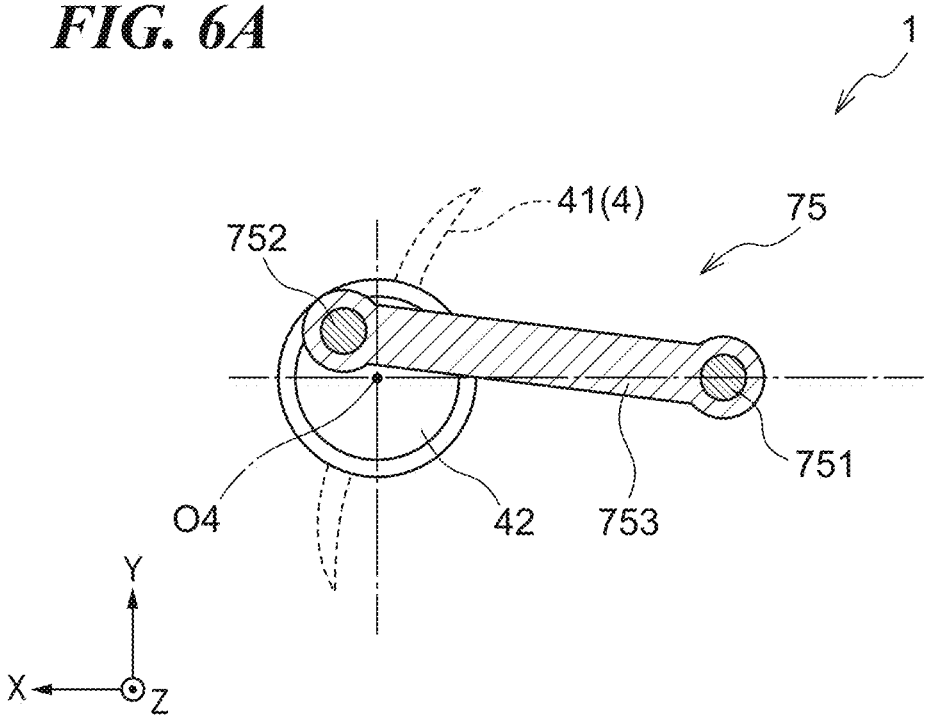
FIGS. 6A and 6B are schematic horizontal section views of a crank portion included in the propulsion device for the marine vessel shown in FIG. 1.
Figure 6B:
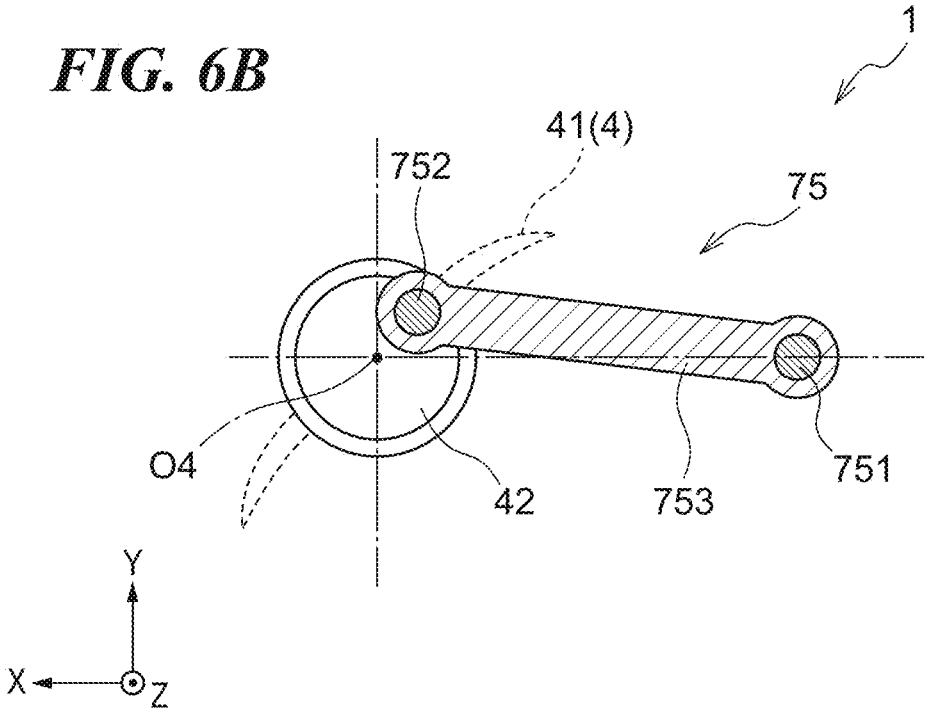

The speed reduction portion 72 outputs the driving force of the second electric motor 32 to the second shaft 71 in response to a rotational speed of the second electric motor 32. As shown in FIGS. 3 and 4, the speed reduction portion 72 includes a first spur gear 721 connected to a rotor (not shown) of the second electric motor 32 and a second spur gear 722 meshing with the first spur gear 721. In addition, as shown in FIG. 5, the speed reduction portion 72 includes a worm 724 coaxially connected to the second spur gear 722 via a connecting shaft 723 and a worm wheel 725 that meshes with the worm 724. The worm wheel 725 is concentric with the second shaft 71 at the upper portion of the second shaft 71. The driving force from the second electric motor 32 is transmitted to the second shaft 71 by the speed reduction portion 72 configured as described above, and the second shaft 71 rotates around the central axis O71.

The pitch changing shaft 73 is disposed on the inside of the propeller shaft 5 concentric with the propeller shaft 5. As shown in FIGS. 3 and 4, the pitch changing shaft 73 is not only able to rotate around the central axis O5 together with the propeller shaft 5, but also able to move along the central axis O5 direction. A sliding member 731, which allows sliding due to movement of the pitch changing shaft 73 with respect to the propeller shaft 5, is provided between the outer peripheral portion of the pitch changing shaft 73 and the inner peripheral portion of the propeller shaft 5.

The second converting portion 74 converts a rotational force of the second shaft 71 into a moving force that moves the pitch changing shaft 73. The second converting portion 74 includes a cylindrical rotating body 76, which is disposed closer to the bow side of the marine vessel 10 than the pitch changing shaft 73, and a moving body 79, which is disposed on the inside of the cylindrical rotating body 76. In addition, the second converting portion 74 includes a second bevel gear 77 provided at the lower end portion of the second shaft 71 and a second bevel gear 78 provided at the rear end portion of the cylindrical rotating body 76. The cylindrical rotating body 76 is supported via a bearing 761 so as to be rotatable around the central axis O5. The second bevel gear 77 rotates together with the second shaft 71 around the central axis O71, and the second bevel gear 78 rotates together with the cylindrical rotating body 76 around the central axis O5. In addition, the second bevel gear 77 and the second bevel gear 78 mesh with each other. Thus, the rotational force of the second shaft 71 is transmitted to the cylindrical rotating body 76 via the second bevel gear 77 and the second bevel gear 78 as a rotational force that rotates the cylindrical rotating body 76. The moving body 79 having a columnar shape is disposed on the inside of the cylindrical rotating body 76. The moving body 79 is screwed to the cylindrical rotating body 76. Thus, the moving body 79 is able to move along the central axis O5 direction when the cylindrical rotating body 76 rotates. It should be noted that the moving body 79 advances or retreats in response to a rotation direction of the cylindrical rotating body 76. In addition, the front end portion of the moving body 79 is supported by a linear bushing 791, and the rear end portion of the moving body 79 is supported by a linear bushing 792. As a result, the moving body 79 is able to advance or retreat smoothly. The screw engagement between the moving body 79 and the cylindrical rotating body 76 may be, for example, a screw engagement using a trapezoidal screw, a screw engagement using a ball screw, or the like.

The pitch changing shaft 73 is connected to the rear end portion of the moving body 79. The positional relationship in the central axis O5 direction between the moving body 79 and the pitch changing shaft 73 is regulated. Thus, the pitch changing shaft 73 is able to move along the central axis O5 direction together with the moving body 79. At a connecting portion between the moving body 79 and the pitch changing shaft 73, the pitch changing shaft 73 is supported via a bearing 732 so as to be rotatable around the central axis O5. In addition, the pitch changing shaft 73 is also supported via a bearing 733 on the side opposite to the bearing 732, that is, on the rear end side.

The crank portion 75 converts the movement of the pitch changing shaft 73 into a change of the pitch of each blade 41 (the corresponding blade 41). As shown in FIGS. 3 and 4, the crank portion 75 includes a columnar shaped protruding portion 751 on the outer peripheral portion of the pitch changing shaft 73, a columnar shaped protruding portion 752 on the supporting portion 42 of the propeller 4, and a connecting member 753 that connects the protruding portion 751 and the protruding portion 752. In the pitch change drive unit 7, the protruding portion 751 is provided for each blade 41, that is, the same number of the protruding portions 751 as the blades 41 are provided. The protruding portions 751 are disposed at equal intervals along the circumferential direction of the pitch changing shaft 73. In the crank portion 75, the protruding portion 752 is disposed on the supporting portion 42 at a position eccentric from the axis O4. The connecting member 753 has a rod shape, the front end portion of the connecting member 753 fits with the protruding portion 752 with a clearance fit, and the rear end portion of the connecting member 753 fits with the protruding portion 751 with a clearance fit. Due to the crank portion 75 being configured as described above, the blade 41 of the propeller 4 is brought into a state shown in FIG. 6B (that is, a state in which the blade 41 of the propeller 4 has been rotated clockwise around the central axis O4) from a state shown in FIG. 6A due to the pitch changing shaft 73 moving rearward. The pitch of the blade 41 is changed by this rotation.

Due to the pitch change drive unit 7 being configured as described above, it is possible to transmit the driving force from the second electric motor 32 to the blades 41 and collectively change the pitches of the blades 41 of the propeller 4 smoothly and quickly. As a result, it is possible to adjust the pitches of the blades 41 to a pitch suitable for a speed of the marine vessel 10 and reduce or prevent a decrease in the propulsion efficiency of the propeller 4 in these speed ranges. For example, it is possible to prevent or reduce the decrease in the propulsion efficiency of the propeller 4 not only when the marine vessel 10 is navigating at high speed but also when the marine vessel 10 is navigating at medium speed or low speed. As a result, it is possible to improve the power efficiency of the second electric motor 32.

Here, for example, the pitch change drive unit 7 will be compared with a case where hydraulic pressure is used to change the pitch (hereinafter, the case is referred to as "a hydraulic pressure configuration"). The pitch change drive unit 7 is able to improve the responsiveness at the time of pitch change by the gears or the like compared to the hydraulic pressure configuration, and is able to perform the pitch change with the smallest possible force with the crank portions 75 or the like. In addition, since the pitch change drive unit 7 may stop the second electric motor 32 after the pitch change, the pitch change drive unit 7 improves the power efficiency when the pitch is maintained compared to the hydraulic pressure configuration that requires electric power to drive an oil pump in order to maintain the hydraulic pressure.

The pitch change drive unit 7 is able to perform the pitch change steplessly. As a result, it is possible to adjust the pitch angle to an arbitrary angle. As described above, the outboard motor 1 includes the information obtaining unit 23 that obtains the information about the pitch angle of each blade 41. In the first preferred embodiment of the present invention, the information obtaining unit 23 includes the angle sensor 231 provided in one blade 41 among the plurality of blades 41 and detects the pitch angle of the one blade 41. The angle sensor 231 is not particularly limited, and for example, may be a sensor using the Hall effect. The outboard motor 1 is able to detect the current pitch angle with the angle sensor 231 and further adjust the pitch angle based on the detection result. It should be noted that the information about the pitch angle of the one blade 41 is not limited to the pitch angle itself, and for example, may be a position of the moving body 79 of the second converting portion 74, or may be a rotation angle or the like of the worm wheel 725 of the speed reduction portion 72. In addition, although the information obtaining unit 23 includes the angle sensor 231 in the first preferred embodiment of the present invention, the information obtaining unit 23 is not limited to the angle sensor 231, and for example, may be appropriately selected from publicly known sensors in response to the type of the information about the pitch angle of the blade 41.

As shown in FIGS. 3 and 4, the outboard motor 1 includes the case 8 that houses the propeller shaft rotation drive unit 6 and the pitch change drive unit 7. The case 8 includes a case main body 80, and a first protruding portion 81 and the second protruding portion 82 that are provided on the lower portion of the case main body 80. The first protruding portion 81 is integral with the case main body 80, and protrudes in a cylindrical shape toward the bow side. A portion of the pitch change drive unit 7 (mainly the second converting portion 74 in the first preferred embodiment of the present invention) is disposed on the inside of the first protruding portion 81. As a result, it is possible to effectively use the space inside of the first protruding portion 81. The second protruding portion 82 is separate from the case main body 80, and protrudes in a cylindrical shape toward the stern side. A portion of the pitch change drive unit 7 (mainly the pitch changing shaft 73 and the crank portions 75 in the first preferred embodiment of the present invention) is disposed on the inside of the second protruding portion 82. As a result, it is possible to effectively use the space inside of the second protruding portion 82. The first protruding portion 81 has a shape whose outer diameter gradually decreases toward the bow side, and the second protruding portion 82 has a shape whose outer diameter gradually decreases toward the stern side. In addition, the first protruding portion 81 and the second protruding portion 82 are coaxial with the propeller shaft 5, that is, are disposed on the central axis O5. As a result, the first protruding portion 81 and the second protruding portion 82 define a spindle shape as a whole, and thus, it is possible to reduce the propulsion resistance of the outboard motor 1. The case 8 includes a fin 83 disposed between the first protruding portion 81 and the second protruding portion 82. The fin 83 is a rectifying plate integral with the lower portion of the first protruding portion 81. The fin 83 functions as a rudder because it rotates around the steering shaft together with the outboard motor 1 when the marine vessel 10 is steered.

Figure 7:
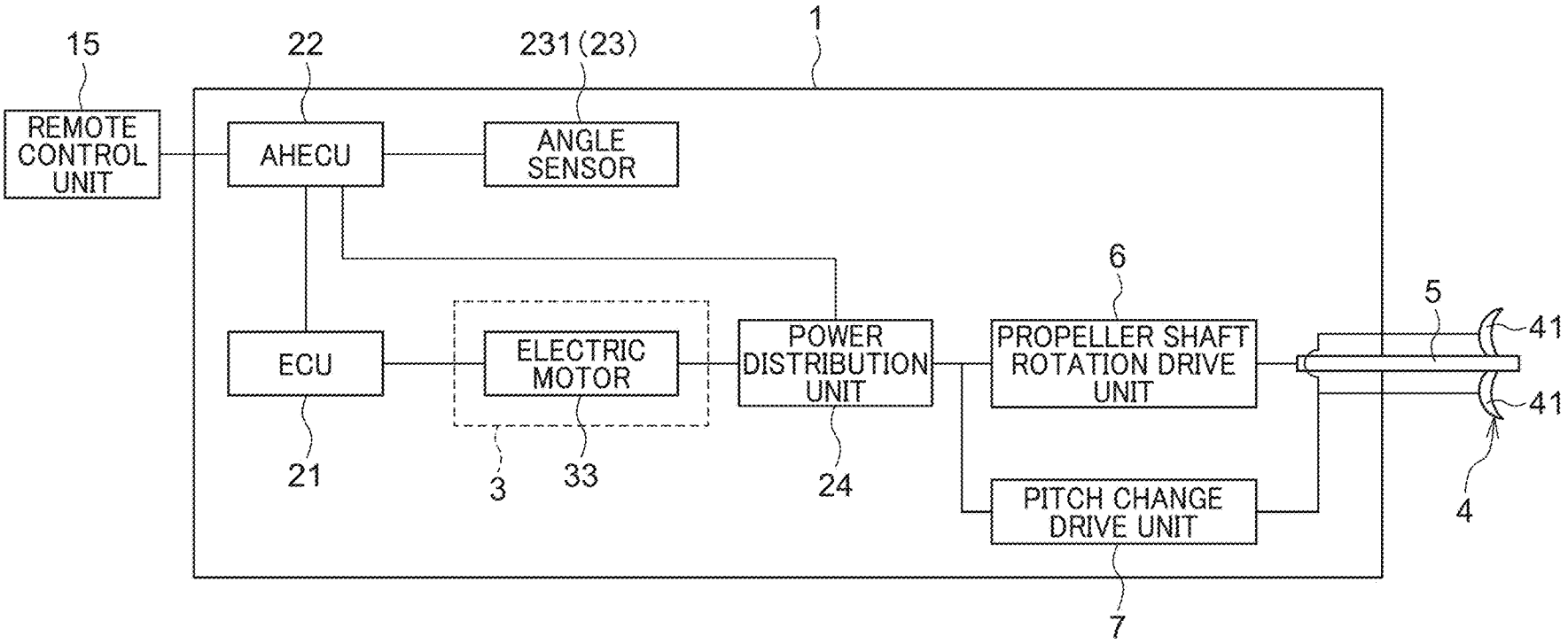
FIG. 7 is a block diagram that schematically shows a configuration of a propulsion device for a marine vessel (an outboard motor) according to a second preferred embodiment of the present invention.

Hereinafter, a second preferred embodiment of the present invention will be described with reference to FIG. 7, the description of the second preferred embodiment will focus on the differences from the first preferred embodiment described above, and the description of the same matters will be omitted. As shown in FIG. 7, in the second preferred embodiment, the driving source 3 includes one electric motor 33. In addition, the outboard motor 1 includes a power distribution unit 24. The power distribution unit 24 distributes the driving force of the electric motor 33 to the propeller shaft rotation drive unit 6 and the pitch change drive unit 7, that is, a device that switches between the driving force to the propeller shaft rotation drive unit 6 side and the driving force to the pitch change drive unit 7. The switching operation of the power distribution unit 24 is controlled by the AHECU 22. It should be noted that the configuration of the power distribution unit 24 is not particularly limited and, for example, may be a configuration in which a plurality of gears are provided and these gears are engaged with each other or separated from each other. Since the outboard motor 1 of the second preferred embodiment includes only one electric motor, it is possible to make this outboard motor 1 lighter than the outboard motor 1 of the first preferred embodiment.

Although preferred embodiments of the present invention have been described above, the present invention is not limited to the above-described preferred embodiments, and various modifications and changes can be made within the scope of the gist thereof. In addition, although the marine vessel propulsion device is the outboard motor 1 in each of the above-described preferred embodiments, it is not limited to the outboard motor, and may be, for example, an inboard/outboard motor. Moreover, although the first shaft 61 and the second shaft 71 are parallel or substantially parallel to each other in each of the above-described preferred embodiments, they are not limited to this, and may be, for example, in a twisted positional relationship.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A propulsion device for a marine vessel that propels the marine vessel, the propulsion device comprising:

a driving source including at least one electric motor;

a propeller including a plurality of blades with changeable pitches and rotatable around a central axis of a propeller shaft together with the propeller shaft;

a propeller shaft rotation driver to transmit a driving force from the driving source to the propeller shaft and rotate the propeller shaft around the central axis; and a pitch change driver to transmit the driving force from the driving source to the plurality of blades and change the pitches of the plurality of blades; wherein the propeller shaft rotation driver includes a first shaft; and the pitch change driver includes a single second shaft parallel or substantially parallel to the first shaft and closer to a bow side of the marine vessel than the first shaft.

2. The propulsion device according to claim 1, wherein the first shaft and the second shaft extend along a direction intersecting the central axis.

3. The propulsion device according to claim 2, wherein the propeller shaft rotation driver includes a first converter to convert a rotational force of the first shaft into a rotational force to rotate the propeller shaft.

4. The propulsion device according to claim 3, wherein the first converter includes first bevel gears on both the first shaft and the propeller shaft and that mesh with each other.

5. The propulsion device according to claim 4, wherein the propeller shaft has a cylindrical or substantially cylindrical shape; and the pitch change driver includes:

a pitch changing shaft on an inside of the propeller shaft and movable along the central axis direction; and a second converter to convert a rotational force of the second shaft into a moving force to move the pitch changing shaft.

6. The propulsion device according to claim 5, wherein the second converter includes:

a cylindrical rotating body to rotate around the central axis;

second bevel gears on both the second shaft and the cylindrical rotating body and that mesh with each other; and a moving body on an inside of the cylindrical rotating body, fixed to the cylindrical rotating body, and movable along the central axis direction together with the pitch changing shaft due to rotation of the cylindrical rotating body.

7. The propulsion device according to claim 5, wherein the pitch change driver includes cranks that each convert movement of the pitch changing shaft into a change of the pitch of the plurality of blades.

8. The propulsion device according to claim 1, wherein the pitch change driver is operable to change the pitch of the plurality of blades steplessly.

9. The propulsion device according to claim 8, further comprising:

an information obtainer to obtain information about a pitch angle of the plurality of blades.

10. The propulsion device according to claim 1, wherein a clearance between the first shaft and the second shaft is about 2 to about 6 times a maximum outer diameter of the first shaft.

11. The propulsion device according to claim 1, further comprising:

a case to house the propeller shaft rotation driver and the pitch change driver; wherein the case includes a first protruding portion that protrudes in a cylindrical shape toward the bow side of the marine vessel; and a portion of the pitch change driver is inside of the first protruding portion.

12. The propulsion device according to claim 11, wherein the first protruding portion has a shape with an outer diameter that decreases toward the bow side of the marine vessel.

13. The propulsion device according to claim 11, wherein the first protruding portion is coaxial with the propeller shaft.

14. The propulsion device according to claim 13, wherein the case includes a second protruding portion that protrudes in a cylindrical or substantially cylindrical shape toward a rear of the case;

the second protruding portion has a shape with an outer diameter that decreases toward the rear of the case; and the case includes a fin between the first protruding portion and the second protruding portion.

15. The propulsion device according to claim 1, wherein the driving source includes two electric motors; and among the two electric motors, one electric motor is connected to the propeller shaft rotation driver and the second electric motor is connected to the pitch change driver.

16. An outboard motor that propels a marine vessel, the outboard motor comprising:

a driving source including at least one electric motor;

a propeller including a plurality of blades with changeable pitches and rotatable around a central axis of a propeller shaft together with the propeller shaft;

a propeller shaft rotation driver to transmit a driving force from the driving source to the propeller shaft and rotate the propeller shaft around the central axis; and a pitch change driver to transmit the driving force from the driving source to the plurality of blades and to change the pitches of the plurality of blades; wherein the propeller shaft rotation driver includes a first shaft; and the pitch change driver includes a single second shaft parallel or substantially parallel to the first shaft and closer to a bow side of the marine vessel than the first shaft.

* * * * *